United States Patent [19]

Kaplow et al.

[11] 4,233,586

[45] Nov. 11, 1980

[54] DISK PACK BOTTOM COVER WITH MAGNETIC LATCH

[75] Inventors: Roy Kaplow, Newton; David E. Butz, Littleton; Alan L. Stenfors, Scituate, all of Mass.

[73] Assignee: Data Packaging Corporation, Cambridge, Mass.

[21] Appl. No.: 1,596

[22] Filed: Jan. 8, 1979

[51] Int. Cl.[3] ..... H01F 3/00; H01F 7/02

[52] U.S. Cl. ..... 335/303; 206/444; 206/818

[58] Field of Search ..... 335/302, 306, 303; 206/444, 818; 248/206 A

[56] References Cited

U.S. PATENT DOCUMENTS

| | | | |
|---|---|---|---|
| 3,786,386 | 1/1974 | Cardone et al. | 335/306 |
| 4,013,169 | 3/1977 | Cheney | 206/444 |
| 4,071,862 | 1/1978 | Lathrop, Jr. et al. | 206/444 |

*Primary Examiner*—Harold Broome

*Attorney, Agent, or Firm*—Wolf, Greenfield & Sacks

[57] ABSTRACT

A bottom cover for a disk pack having a magnet assembly secured to the cover bottom wall by an inverted channel. The magnet assembly includes pole pieces made of parallel plates that register with slots in the channel and permanent magnets disposed between the plates and within the channel.

11 Claims, 8 Drawing Figures

24A
1
24
24A
30

21C
21A
22
28
23
30
23
27
23
22
21B
21A
20
21B
21A
22
30
21
22
21C
21A 7
20
28
7
24
25
24
25
30
24
27
3
4
5
3
3
24
24
24
21
30

Fig. 4
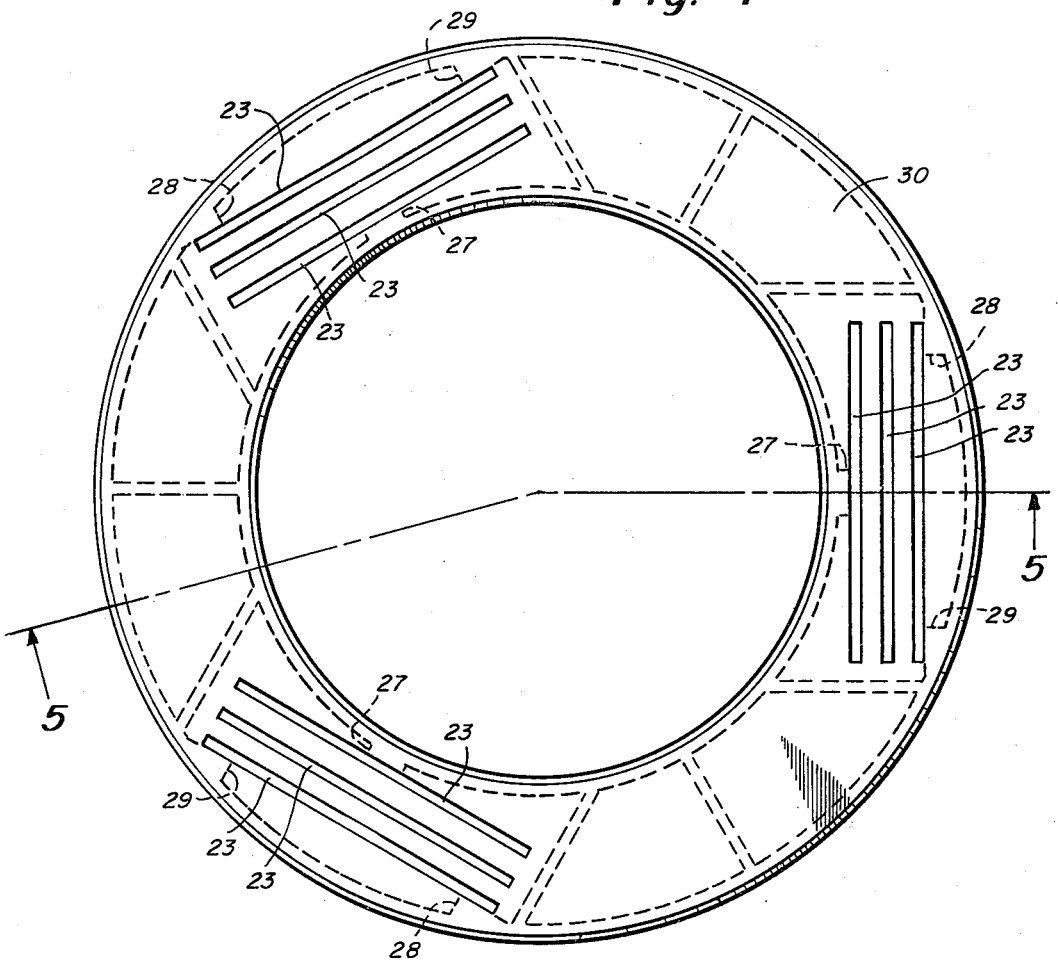
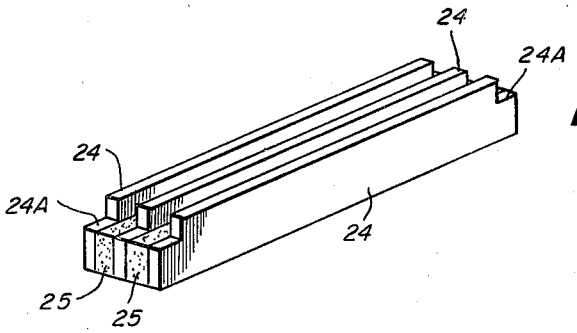
Fig. 6
Fig. 8
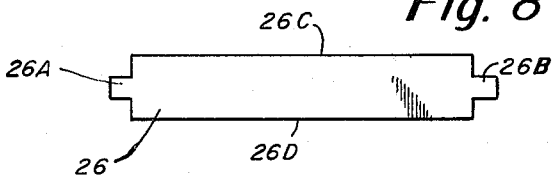

DISK PACK BOTTOM COVER WITH MAGNETIC LATCH

FIELD OF THE INVENTION

This invention relates in general to a disk pack container and more particularly pertains to an improved arrangement for the magnetic latching of the bottom cover of the container.

BACKGROUND OF THE INVENTION

Magnetic disks are widely used in electronic data processing systems for the storage and retrieval of information. To protect the magnetic disks, the disks are enclosed in dustproof housings having latchable bottom covers. The disks and their housings are known as disk packs. When it is desired to use a disk, the bottom cover is removed from the housing to enable read-write heads to be brought into close proximity to the information surfaces of the disk while the disk is being rotated. In one type of disk pack having but a single disk in it, a handle on the housing is provided to facilitate carrying of the disk pack. This handle and attendant mechanism also control the unlatching of the bottom cover by separating the magnetic elements joining the bottom cover to the rest of disk pack.

It has been conventional to construct the disk pack housing by injection molding of a synthetic plastic material. Because of their high flux density, Alnico magnets have been employed as the primary element of the magnetic latching device, and the magnets have been secured to the bottom cover by embedding them in the molded material of the bottom cover. In forming the bottom cover, the magnets are held in place within the mold by their magnetic force. This has caused some difficulty because on occasion weak magnets have damaged the molds by falling from their proper locations during the injection molding operation. Furthermore, this method requires a relatively lengthy molding cycle to insure that the magnets remain in their proper position. It should also be noted that because of a scarcity of cobalt, the price of the Alnico magnets has become prohibitive.

THE DRAWINGS

FIG. 4 is a top plan view of the retainer ring employed in the embodiment of the invention shown in FIG. 3;

FIG. 6 is a perspective view of the magnet and pole piece assembly employed in the present invention;

FIG. 8 is a side view of an alternative form of pole piece that may be used in the magnet assembly.

DETAILED DESCRIPTION OF THE DRAWINGS

Figure 1:
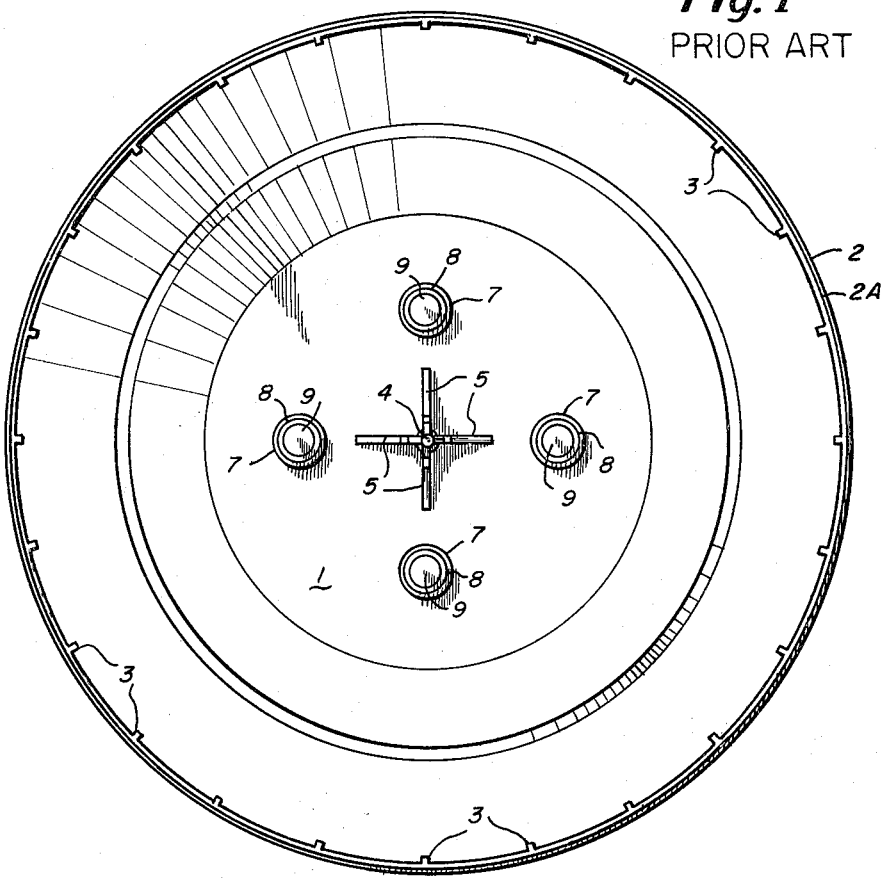
Fig. 1 PRIOR ART
FIG. 1 is a top plan view of the prior art bottom cover and shows the symmetrical disposition of the magnets of the latching device.
Figure 2:
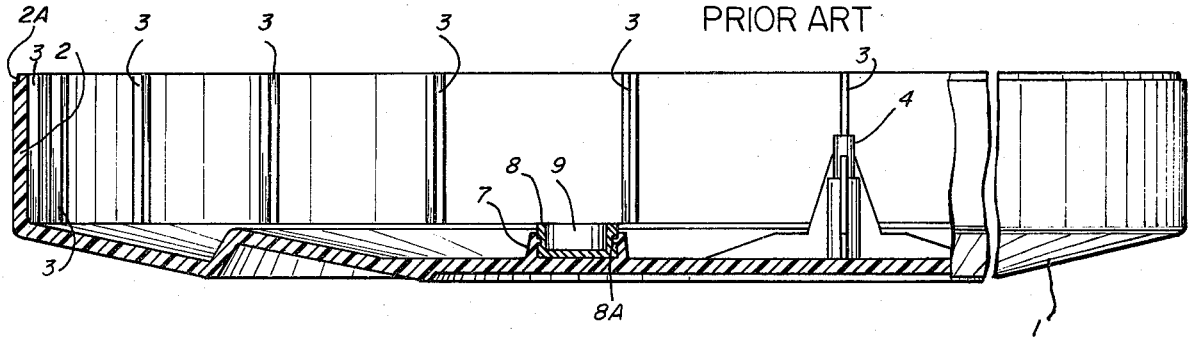
Fig. 2 PRIOR ART
FIG. 2 is a horizontal view of the prior art bottom cover of FIG. 1 with a portion of the rim of the cover broken away to show one of the embedded Alnico magnet assemblies.

FIGS. 1 and 2 depict a conventional disk pack bottom cover 1 formed by the injection molding of a synthetic non-magnetic plastics material. The cover is of circular configuration and has an upturned rim 2 whose upper edge 2A is inwardly stepped. Spaced around the inside periphery of the rim are ribs 3 which form slight inward protrusions. At the center of the lid is a post 4 that extends upwardly from the floor. As shown in FIG. 2, the post is braced laterally by buttresses 5 which are symmetrically arranged around the post. Disposed on the floor of the cover are receptacles 7 in which are secured permanent magnet assemblies formed by steel cups 8 containing permanent magnets 9. As shown in FIG. 1, the four permanent magnet assemblies are disposed symmetrically about post 4 in alignment with the buttresses 5. Each permanent magnet assembly is made by pressing an Alnico magnet into the steel cup so that the bottom face of the magnet is brought into contact with the bottom of the steel cup. A non-magnetic liner is interposed between the side wall of the steel cup and the permanent magnet to provide a lateral gap that prevents the magnetic flux of the magnet from being short circuited through the magnetic cup. The non-magnetic liner is formed, for example, by electro-plating the side wall of the cylindrical magnet with pure nickel. The steel cup, in the assembly, acts as one pole piece with the exposed upper surface of the magnet providing the opposite pole. As shown in FIG. 2, the steel cup 8 has an external circular groove 8A. During molding of the bottom cover, the plastic material flows into the circular groove and upon solidifying locks the steel cup in the receptable 7.

The bottom cover latches to the housing of the disk pack in the manner shown in the copending application of David E. Butz, Ser. No. 969,073, filed Dec. 13, 1978 and assigned to the assignee of the present application. Briefly, a steel plate having a central aperture through which the post 4 passes, is lowered into contact with the permanent magnets 9 of the bottom cover. The steel plate is magnetically attracted to the permanent magnets, and this engagement latches the bottom cover to the housing of the disk pack container. To disengage the bottom cover from the housing, the steel plate is raised, while the bottom cover is prevented from following the movement of the steel plate by downward pressure applied to the central post 4 and the peripheral edge 2A of the bottom cover.

Figure 5:
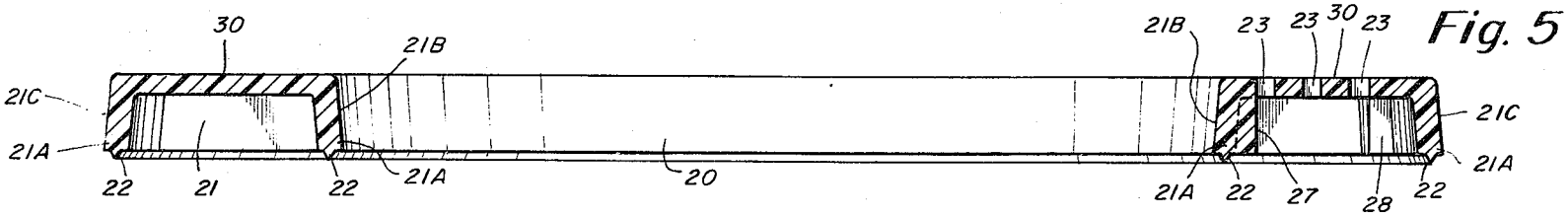
FIG. 5 is a horizontal sectional view taken along the section line 5—5 of FIG. 4.

The improved magnetic latching arrangement for the bottom cover of this invention is depicted in FIGS. 4–8. An annular retaining ring 20 is molded from a non-magnetic plastic material that is preferably the same material used for the bottom cover, typically polycarbonate. The retaining ring, as indicated in FIG. 5, provides an inverted U-shaped channel 21 that extends around the ring. The bottom edges 21A of the inner and outer sides 21B and 21C of the channel carry beads 22 to facilitate ultrasonic welding of the retaining ring to the cover.

Groups of parallel slits 23 are provided in the retaining ring. The slits are arranged in groups of three, and the groups are symmetrically spaced around the retaining ring. While three groups of slits are depicted in FIG. 4, it will be apparent that fewer or more groups may be employed, depending upon the desired strength of the magnetic latch. Further, it will be apparent that each of the groups may have fewer or more than three slits.

Protruding through the slits, are plates 24 of a readily magnetizable material such as iron or steel. As shown in FIG. 6, the plates are provided with a shoulder 24A at each end. Between plates is interposed a permanent magnet 25 made of a magnetic ferrite material embedded in a rubbery synthetic material. The plates on either side of the permanent magnet acts as pole pieces with one plate being a North pole and the other plate being a South pole. In a three plate assembly, the magnets are arranged to make the middle plate of one magnetic polarity and the outer two plates of the opposite magnetic polarity.

Figure 7:
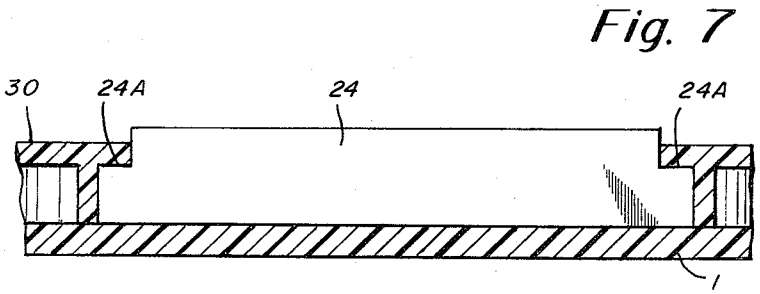
FIG. 7 is a fragmentary cross sectional view taken along section line 7—7 of FIG. 3.

As shown in FIG. 7, the pole pieces 24 extend through the slots in the retaining ring. The slots are somewhat shorter in length than the longest dimension of the plates 24, and the shoulders 24A lie beneath the top wall 30 of the channel and prevent the pole pieces from being pulled through their respective slots. Consequently, when a pole piece is pulled upwardly, the lifting force is transmitted by the shoulders 24A to the retaining ring and therethrough to the bottom cover.

An alternative form of pole piece 26 is depicted in FIG. 8 in which the pole piece shoulders are defined by lateral tabs 26A and 26B protruding from the ends of the pole piece. The pole piece 26 is symmetric in form so that either edge 26C or 26D of the pole piece can extend through the slot in the retaining ring.

To aid in maintaining the magnetic assemblies in place within the retaining ring 20, the interior U-shaped channel of the ring is provided with lugs 27, 28 and 29 as shown in FIG. 4. The lugs insure that the pole pieces 24 are kept in close contact with the interposed permanent magnets 25. Other means, of course, can be employed to keep the pole pieces and interposed permanent magnets in close contact. For example, they may be held together by rivets, adhesive, clips, tape, potting material, etc.

Figure 3:
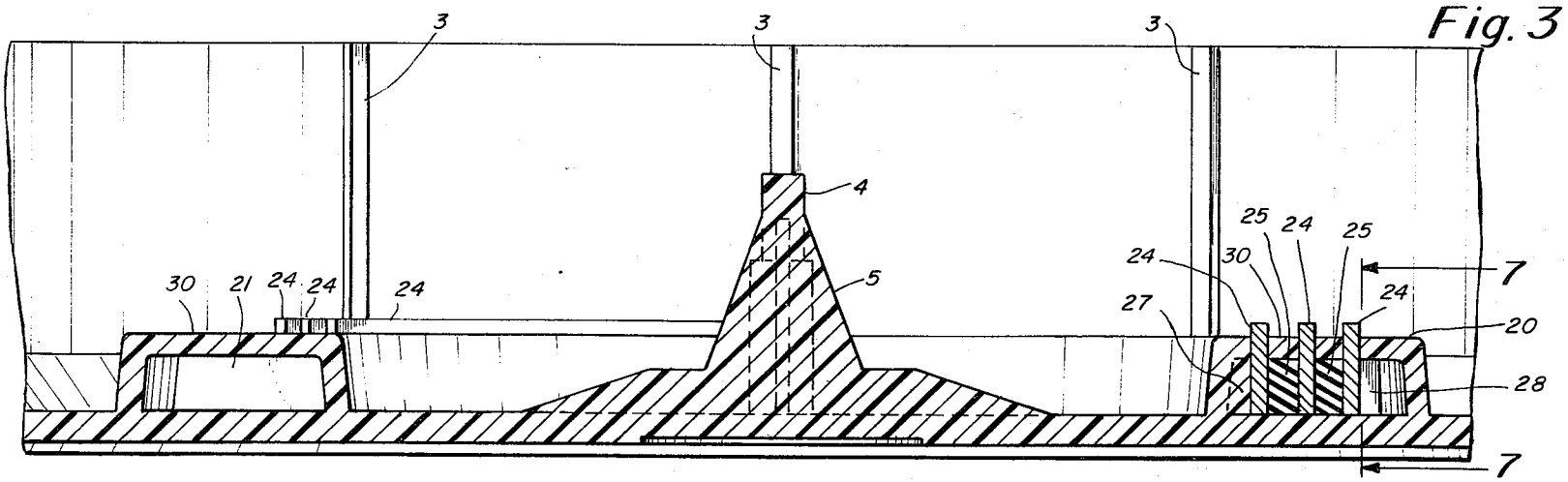
FIG. 3 is a fragmentary horizontal sectional view showing the preferred embodiment of bottom cover constructed in accordance with the present invention.

In assembling the bottom cover of this invention, the pole piece and magnet assemblies are placed in position within the retaining ring, and the retaining ring is then ultrasonically welded to the bottom cover. The retaining ring thereby becomes an integral part of the bottom cover as depicted in FIG. 3. The assembly procedure avoids the difficulty of having the magnets present during the injection molding of the bottom cover and shortens the molding cycle.

We claim:

1. A magnetically latched bottom cover for a disk pack container, the cover being of the type constructed of a non-magnetic material and having a floor from which a central post extends upwardly, the improvement comprising:

(1) an annular retaining ring of non-magnetic material, the retaining ring surrounding the central post and being attached to the floor of the cover, the retaining ring providing a channel therein, and the retaining ring having parallel elongate slots extending therethrough to the channel, (2) a plurality of parallel elongate plates disposed in the annular channel and extending through the parallel slots, (3) a permanent magnet situated in the channel between two adjacent parallel plates whereby the plates act as magnetic poles of opposite polarity, and (4) means associated with the pole plates whereby the pole pieces are prevented from being pulled through the slots and the pulling forces are transmitted to the retaining ring and therethrough to the bottom cover.

2. In a disk pack, a bottom cover comprising:

a bottom wall, an inverted channel member having top wall and side walls with the side walls secured to the upper surface of the bottom wall, said channel member defining with this bottom wall a housing for a magnetic latching element, a group of spaced apart slots in the top wall of the channel member, a group of spaced apart pole pieces equal in number to the number of slots and disposed in the housing and registering with the slots, and a magnet disposed in the housing and energizing the pole pieces.

3. In a disk pack as defined in claim 2, said channel member being annular in shape and being secured to the bottom wall coaxially with the bottom cover, and at least one additional group of slots spaced circumferentially from the first recited group and with the additional group having pole pieces and a magnet like those associated with said first recited group.

4. In a disk pack as defined in claim 3, each group of slots comprising three parallel and coextensive slots, and the pole piece mounted in the central slot of each group being of the opposite polarity to the pole pieces in the other slots.

5. In a disk pack as defined in claim 4, shoulders provided on each of the pole pieces and engaging the bottom surface of the channel member so as to be retained in the channel member.

6. In a disk pack as defined in claim 3, means in the channel member and engaging the pole pieces to maintain the pole pieces and magnets in contact with one another.

7. In a disk pack as defined in claim 6, said means being lugs formed in the channel member.

8. A disk pack bottom cover comprising a bottom wall and a hollow ring mounted on the bottom wall, said ring having means defining integral side walls secured to the bottom wall and defining with the bottom wall a substantially closed housing having a top wall, a plurality of groups of parallel slots formed in the top wall of the ring, a magnet assembly associated with each group of slots, said assemblies including pole pieces disposed in the housing and registering with and extending through the slots, each of said assemblies also including permanent magnets disposed between the pole pieces and beneath the top wall of the ring, and means for securing the magnet assemblies together.

9. A disk pack bottom cover as defined in claim 8 further characterized by said magnet assemblies each comprising three straight, flat, spaced apart, parallel plates that define the pole pieces, and a flat permanent magnet disposed in each space between the parallel plates.

10. A disk pack bottom cover comprising a bottom wall and a ring mounted on the bottom wall, a plurality of groups of parallel slots formed in the ring, a magnet assembly associated with each group of slots, said assemblies including pole pieces disposed beneath the ring and registering with and extending through the slots, each of said assemblies also including permanent magnets disposed between the pole pieces and beneath the ring, and means for securing the magnet assemblies together, each of the plates having one long side edge extending through a slot in the ring, and shoulders provided at the ends of the plates and disposed beneath the ring for retaining the assemblies beneath the ring.

11. A disk pack bottom cover comprising a bottom wall and a ring mounted on the bottom wall, a plurality of groups of parallel slots formed in the ring, a magnet assembly associated with each group of slots, said assemblies including pole pieces disposed beneath the ring and registering with and extending through the slots, each of said assemblies also including permanent magnets disposed between the pole pieces and beneath the ring, and means for securing the magnet assemblies together, each plate having parallel side edges with each edge being adapted to extend through a slot in the ring, and shoulders formed at each end of each edge of each plate so that when the bottom cover is assembled, each edge may be positioned to register with and extend through a slot and the shoulders may secure the plates to the ring.

* * * * *